US010436524B2

(12) United States Patent
Wongwises et al.

(10) Patent No.: US 10,436,524 B2
(45) Date of Patent: Oct. 8, 2019

(54) MIXED LOUVER SPIRAL FIN

(71) Applicant: King Mongkut's University of Technology Thonburi, Bangkok (TH)

(72) Inventors: Somchai Wongwises, Bangkok (TH); Parinya Kiatpachai, Bangkok (TH)

(73) Assignee: King Mongkut's University of Technology Thonburi, Bangkok (TH)

( * ) Notice: Subject to any disclaimer, the term of this patent is extended or adjusted under 35 U.S.C. 154(b) by 3 days.

(21) Appl. No.: 15/321,744

(22) PCT Filed: Jun. 30, 2015

(86) PCT No.: PCT/TH2015/000040
§ 371 (c)(1),
(2) Date: Dec. 22, 2016

(87) PCT Pub. No.: WO2016/003374
PCT Pub. Date: Jan. 7, 2016

(65) Prior Publication Data

US 2017/0131039 A1 May 11, 2017

(30) Foreign Application Priority Data

Jul. 3, 2014 (TH) ..... 1401003866

(51) Int. Cl.
*F28F 1/12* (2006.01)
*F28F 1/36* (2006.01)
*F28D 1/047* (2006.01)

(52) U.S. Cl.
CPC ..... *F28F 1/36* (2013.01); *F28D 1/0477* (2013.01); *F28F 2215/08* (2013.01)

(58) Field of Classification Search
CPC ..... F28D 1/047; F28D 1/0477; F28F 1/12; F28F 1/128; F28F 1/36; F28F 1/34
USPC ..... 165/181, 184
See application file for complete search history.

(56) References Cited

U.S. PATENT DOCUMENTS 2,965,555 A 12/1960 Hall
3,288,209 A * 11/1966 Wall ..... F28F 1/36 165/184
4,138,997 A * 2/1979 LaPorte ..... F24J 2/26 126/658
5,240,070 A * 8/1993 Ryan ..... F28F 1/36 165/181
5,377,746 A * 1/1995 Reid ..... F28F 1/36 165/133
5,420,070 A 5/1995 Matsuura
(Continued)

FOREIGN PATENT DOCUMENTS

CN 101126613 A 2/2008
CN 101240987 A 8/2008
(Continued)

*Primary Examiner* — Filip Zec
(74) *Attorney, Agent, or Firm* — Eliza Stefaniw

(57) ABSTRACT

The mixed louver spiral fin is a development of the conventional spiral fin-and-tube heat exchanger having louvers at the surface of the fin. Louvers are made on the fin surface for enhancing heat transfer performance. The louvers made are perpendicular and parallel with the radius of the fin. The mixed louver spiral fin can be used for building heat exchangers with heat exchange between fluids, such as gas, liquid, or gas-liquid two phases or application in heat exchangers for waste heat recovery.

8 Claims, 5 Drawing Sheets

(56) References Cited

U.S. PATENT DOCUMENTS

| | | | | |
|---|---|---|---|---|
| 6,789,317 | B1 * | 9/2004 | Sohal | B21C 37/26 29/890.03 |
| 6,976,301 | B2 | 12/2005 | O Brien | |
| 7,093,650 | B2 | 8/2006 | Hashimoto | |
| 2010/0282456 | A1 * | 11/2010 | Benignos | F28F 1/30 165/182 |

FOREIGN PATENT DOCUMENTS

| | | | |
|---|---|---|---|
| CN | 101881571 | A | 11/2010 |
| EP | 0854344 | B1 | 7/2003 |
| GB | 1382783 | A | 2/1975 |
| JP | 2000121269 | A2 | 4/2000 |
| JP | 2012137216 | A2 | 7/2012 |

* cited by examiner

MIXED LOUVER SPIRAL FIN

TECHNICAL FIELD

Mixed louver spiral fin can enhance the heat transfer performance of fin-and-tube heat exchangers, and is related to fluid mechanics, heat transfer, refrigeration, and air-conditioning.

BACKGROUND ART

Abundance of the nation's natural resources has decreased because humans have required energy from fossil fuels such as coal, oil, and natural gas. Fossil fuel is used to excess. Thus the pollution from using energy will lead to global warming. Therefore, countries are increasingly aware of the urgent need for energy-efficiency improvements. For this reason, heat exchangers are studied and improved for enhanced heat transfer performance. The literature review showed that scientists and researchers have interest in the research problems related to heat exchangers for enhancing heat transfer. Presently, the geometry of the heat exchanger for use in limited space is increasingly important. Thus, the heat exchanger's design is a challenging subject for further investigation in order to improve technology. The economizer is a heat exchanger used in many industrial applications. An economizer can improve cost savings by waste heat recovery. It is a spiral fin-and-tube heat exchanger. The spiral fin is a surface that extends from the tube to increase heat transfer surface area. Hence, the improvement and development of a spiral fin for heat transfer enhancement is the aim of researchers. A thermal system's increased energy efficiency will have a significant effect on increasing heat transfer performance of heat exchangers. Moreover, it will lead to a more compact heat exchanger for limited space applications, which reduces cost of manufacture. Therefore, the spiral fin-and-tube heat exchanger for high heat transfer performance will use the optimal type of louver spiral fin, herein called a "Mixed Louver Spiral Fin-and-Tube Heat Exchanger". Additionally, this kind of louver spiral fin is used in the new types of heat exchangers. It will lead to innovation in economizer design in the twenty-first century to respond to world energy consumption.

The energy crisis is one motivation for improvement of energy efficiency in industrial applications. Therefore, the research about the heat exchanger improvement has a significant effect on studying heat transfer performance enhancement. Since a heat exchanger may consist of a tube and a fin, improving the fin patterns is one way to augment the heat transfer performance on the air side of the heat exchanger. Furthermore, the tube arrangement, type of working fluid, and material of the heat exchanger itself has significance for heat exchanger design. The spiral fin-and-tube heat exchanger is the type of fin-and-tube heat exchanger favored in industrial application.

SUMMARY OF THE INVENTION

This work will lead to enhanced heat transfer performance in a spiral finned tube heat exchanger. This type of heat exchanger is also commonly called an "Economizer" and is used in industrial sectors in waste heat recovery systems. The heat transfer between fluids can be enhanced by improving the fin patterns. The fin patterns have a significant effect on the flow characteristics of fluid passing through the heat exchanger. The flow characteristics can enhance the heat transfer performance of the heat exchanger. However, it should be noted that an increasing pressure drop will occur.

This work is an improvement of a conventional spiral fin, which can be built as a louver on the fin surface. Hence, it is innovation of spiral fin design. The new kind of spiral fin is called "Mixed Louver Spiral Fin", which will enhance air-side heat transfer performance. This louver spiral fin will provide heat transfer enhancement. For increasing energy efficiency in thermal processes such as air-conditioning, refrigeration, and waste heat recovery, the mixed louver spiral fin disclosed herein has an innovatively designed spiral fin. The mixed louver spiral fin will be a foundation of spiral fin-and-tube heat exchanger design in the future for improving energy efficiency. In addition, it can be noted that mixed louver spiral fin will lead to compact heat exchangers for use in limited space applications.

DISCLOSURE OF THE INVENTION

Figure 1:
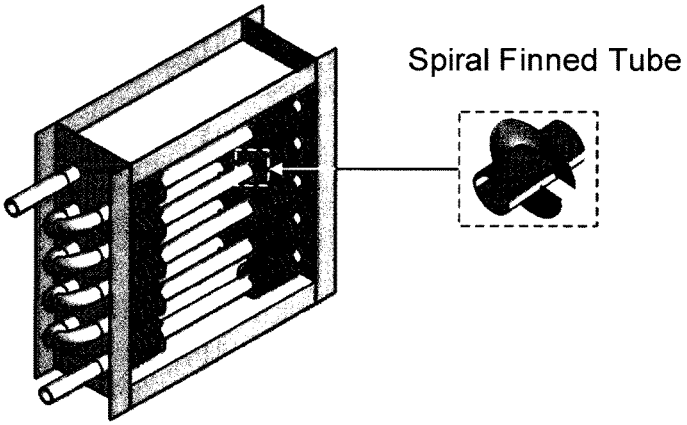
FIG. 1 Spiral fin-and-tube heat exchanger

The spiral fin is consistent with use with a tube, assembled as a unit to form the heat exchanger, as seen in FIG. 1. It shows the spiral fin-and-tube heat exchanger for heat exchange between fluids, which is called an "Economizer," for use in waste heat recovery applications.

Figure 2:
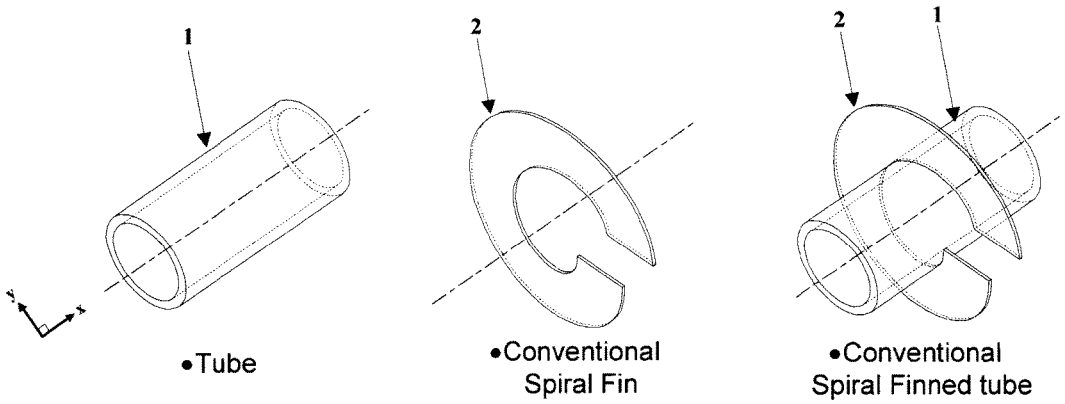
FIG. 2 Conventional spiral finned tube

FIG. 2 shows the components of a conventional spiral finned tube, which has a tube (1) having cylindrical shape for conveying the working fluid, and a conventional spiral fin (2) wherein the plate is covering the tube in a helical formation along the tube (1). The spiral fin increases the surface area thereby increasing the heat transfer performance. The conventional spiral fin (2) is made from materials, such as steel, copper, brass, aluminum, stainless steel, or the like, which can be formed.

Figure 3:
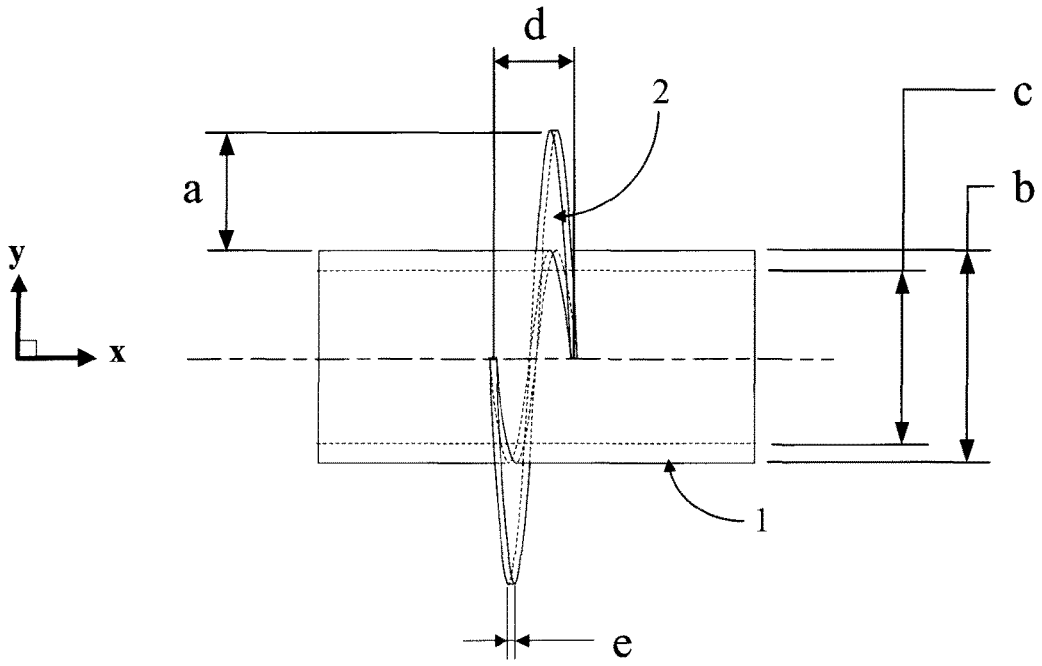
FIG. 3 Schematic diagram for tube, conventional spiral fin, and conventional spiral finned tube FIG. 4 Mixed louver spiral fin FIG. 5 Cross section of A-A and B-B of mixed louver spiral fin FIG. 6 Louver sets for mixed louver spiral fin

FIG. 3 is a schematic diagram showing a tube (1), conventional spiral fin (2), and conventional spiral finned tube. The conventional spiral finned tube has dimensions including fin height (a), outside diameter (b), inside diameter (c), fin pitch (d), and fin thickness (e). For (a), (b), (c), (d), and (e), all parameters are reasonable values for manufacture.

Figure 4A:
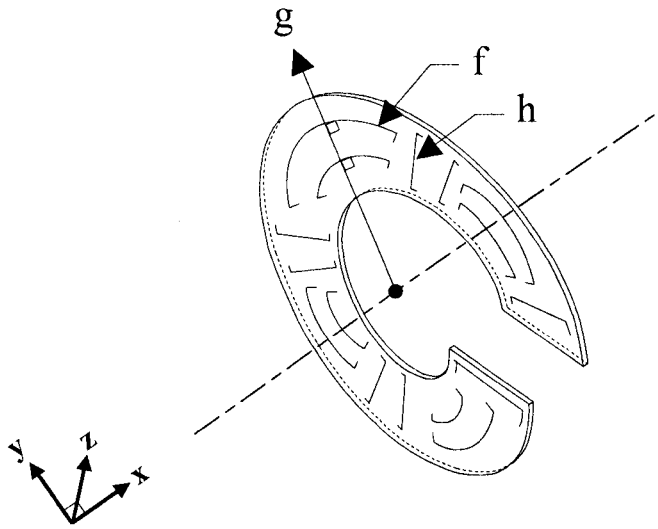
Figure 4B:
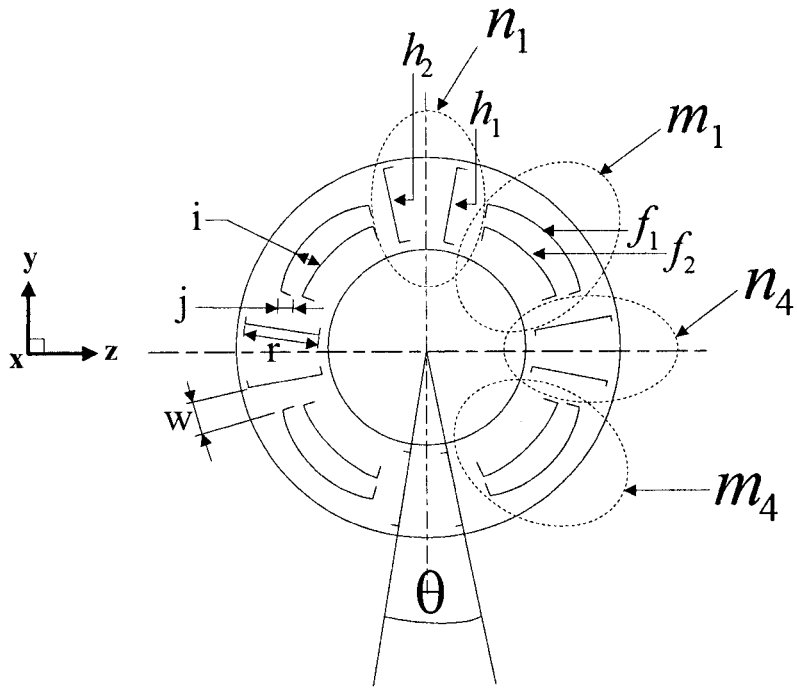

FIG. 4 shows two perspective views of the mixed louver spiral fin disclosed herein. First a surface like a conventional spiral fin (2) is made by using a punching machine on the fin surface, which is also punched to cut the louver shape. FIG. 4A shows how louvers (f) and louvers (h) are positioned on the fin surface for enhancing heat transfer performance, which is perpendicular and parallel with the radius of fin (g), respectively. Moreover, the louver (f) and louver (h) may be formed in louver sets (m) and (n), respectively as shown in FIG. 4B. FIG. 4B shows a mixed louver spiral fin, which comprises louver sets (m) of 4 groups in the example shown (i.e., $m_1$, $m_2$, $m_3$, and $m_4$) and louver sets (n) of 4 groups in the example shown (i.e., $n_1$, $n_2$, $n_3$, and $n_4$) where each set of louvers (m) comprises a fixed number of louvers (f), in the example shown there are 2 louvers (i.e., $f_1$ and $f_2$) in each set (m) and where each set of louvers (n) comprises a fixed number of louvers (h) totaling 8 in the example shown (i.e., $h_1$, $h_2$, $h_3$, $h_4$, $h_5$, $h_6$, $h_7$ and $h_8$). Each louver has louver length in the plane of the spiral fin (j) and louver spacing (i) for protection during fin cutting. In particular, louvers (h) have louver length (r). It is found that louver spacing will depend on the angle θ, which is in the range between 0° to 90°. The angle θ decreases with an increasing number of louvers (h). Furthermore, the louver spacing (w) between louvers (h) and louvers (f) provides a space of protection (or tolerance) for cutting machines.

Figure 5A:
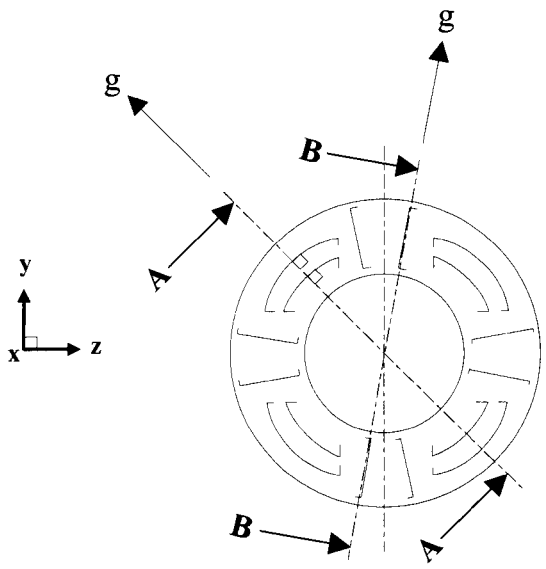
Figure 5B:
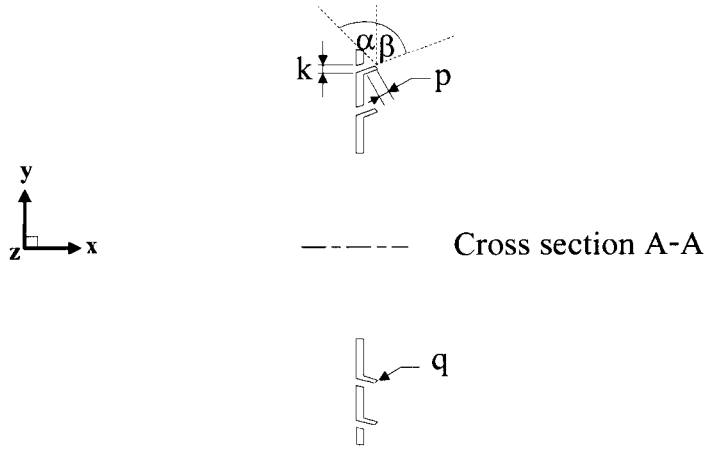
Figure 5C:
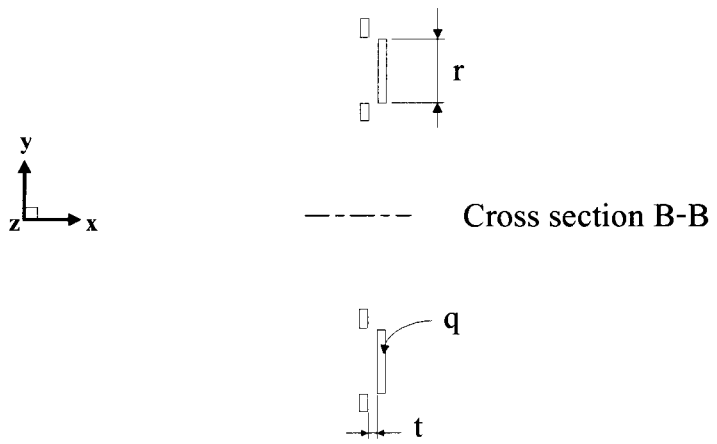

FIG. 5 shows cross sections of a mixed louver spiral fin along lines A-A and B-B indicated in the perspective view shown in FIG. 5A. The cross sections along lines A-A and B-B from FIG. 5A are seen in FIG. 5B and FIG. 5C, respectively. FIG. 5B shows the cross section A-A of mixed louver spiral fin, where angles β and α are indicated in the plane of louver tip (q), having louver length extending out from the plane of the spiral fin (p), angles β and α are measured from the vertical line, as seen in FIG. 5B. The effect of louver angles β and α will lead to heat transfer enhancement, because the louver width (k) generates turbulent flow and increases air flow passing through the louver channel, as β and α approach 90°. In addition, the louvers (f) and louvers (h) will increase the strength of the spiral fin structure. FIG. 5C shows the cross section B-B of mixed louver spiral fin, which indicates the louver thickness (t). It is found that the angle θ is related to the number of louvers (h), when the number of louvers (h) increases there is increasing turbulent flow. By varying parameters such as (i), (j), (k), (p), (q), (r), (s), (t), (θ), (β), and (α), the geometry of a mixed louver spiral fin may be confirmed under practical manufacturing conditions in industrial application.

Figure 6:
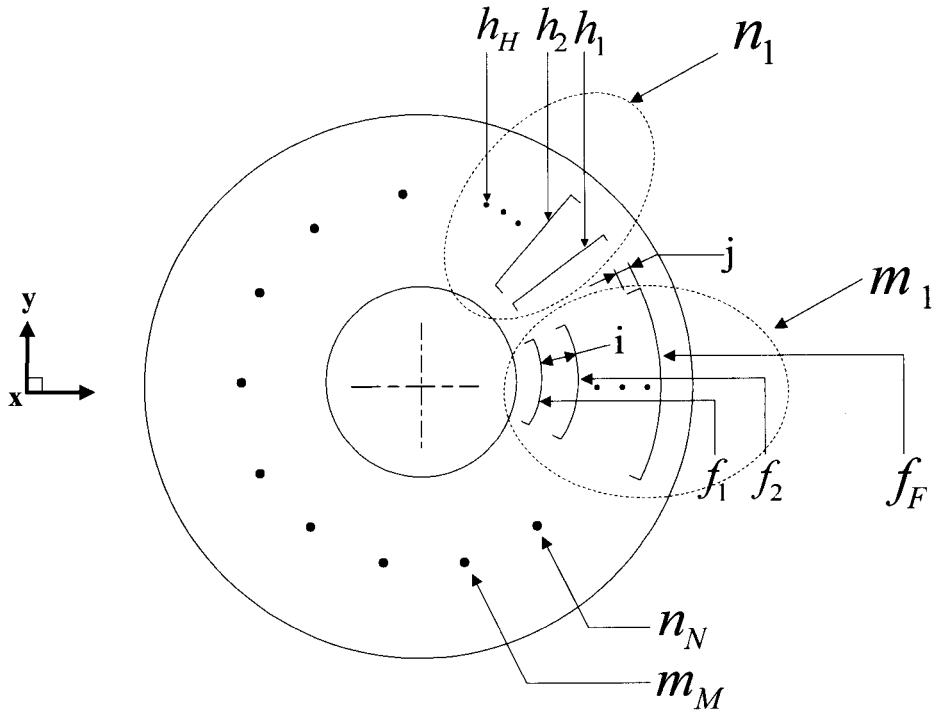

As seen in FIG. 6, a mixed louver spiral fin has the louver sets (m), the number of louver sets M ($m_M$), and the number of layers of louver equal to F ($f_F$). Additionally, the mixed louver spiral fin also has the louver sets (n), the number of louver sets N ($n_N$), and the number of layers of louver equal to H ($h_H$), as shown in FIG. 6. Those parameters must be related to the fin height (a) of spiral fin (2), and can be used for manufacturing the heat exchanger for heat exchanging between the fluids, such as gas, liquid, or gas-liquid two phase mixtures, or application in the heat exchanger for waste heat recovery.

INDUSTRIAL APPLICABILITY

The mixed louver spiral fin disclosed herein is an innovative fin, which may be applied in industrial sectors such as the air conditioning and refrigeration industries and the like. The mixed louver spiral fin disclosed herein may be used to replace the conventional spiral fin.

The invention claimed is:

1. A mixed louver spiral fin comprising:

a cylindrical tube (1) for conveying a working fluid, the cylindrical tube having an outside diameter (b), and an inside diameter (c), and a spiral fin contacting along the cylindrical tube, the spiral fin configured to increase heat transfer surface area thereby increasing heat transfer performance of the mixed louver spiral fin wherein the spiral fin has geometrical dimensions as follows:

fin height, fin pitch, and fin thickness and wherein the spiral fin is formed from at least one of steel, copper, brass, aluminum, and stainless steel, and the spiral fin comprises a first type of louvers (f) and a second type of louvers (h) made on a fin surface of the spiral fin for enhancing heat transfer performance, wherein the first type of louvers (f) and the second type of louvers (h) are, respectively, perpendicular and parallel with associated radii of the spiral fin, and have louver spacing for protection during fin cutting and wherein a louver tip (q) associated with the first type of louvers has a louver wide length, a louver width, a louver thickness, and a louver height length and wherein an angle β presents an angle between a line extending from the louver tip and a vertical line for enhancing turbulence of air, gas, or fluid, passing the fin and a value of the angle β is in a range between 0° to 90°; and wherein the first type of louvers (f) are arranged in a plurality of first louver sets (m), each first louver set including at least one or more of the first type of louvers and the plurality of first louver sets is distributed circumferentially on the fin surface of the spiral fin and perpendicular with the associated radius of the spiral fin, and wherein the second type of louvers (h) are arranged in a second plurality of second louver sets (n), each second louver set including at least one or more of the second type of louvers and the second plurality of second louver sets is distributed circumferentially on the fin surface of the spiral fin and parallel with the associated radius of the spiral fin, and wherein additional louver spacing between the second type of louvers (h) and the first type of louvers (f) is space providing protection for cutting machines, and wherein an angle θ is an angle between adjacent layers of the second type of louvers (h) in one of the second louver sets (n) and is valued in a range between 0° to 90°.

2. The mixed louver spiral fin of claim 1, wherein the first type of louvers are punched into the fin surface.

3. The mixed louver spiral fin of claim 1, wherein the second type of louvers are punched into the fin surface.

4. The mixed louver spiral fin of claim 1, wherein the cutting machines include a punching machine.

5. The mixed louver spiral fin of claim 1, wherein the first louver sets (m) of the first type of louvers and the second louver sets (n) of the second type of louvers are alternatingly distributed on the fin surface of the spiral fin.

6. The mixed louver spiral fin of claim 1, wherein the plurality of first louver sets (m) of the first type of louvers is equal in number to the second plurality of second louver sets (n), where the first louver sets (m) of the first type of louvers and the second louver sets (n) of the second type of louvers are alternatingly distributed on the fin surface of the spiral fin.

7. The mixed louver spiral fin of claim 1, wherein the plurality of first louver sets (m) of the first type of louvers is larger than the second plurality of second louver sets (n), where the first louver sets (m) of the first type of louvers and the second louver sets (n) of the second type of louvers are alternatingly distributed on the fin surface of the spiral fin.

8. The mixed louver spiral fin of claim 1, wherein the plurality of first louver sets (m) of the first type of louvers is smaller than the second plurality of second louver sets (n), where the first louver sets (m) of the first type of louvers and the second louver sets (n) of the second type of louvers are alternatingly distributed on the fin surface of the spiral fin.

* * * * *